United States Patent [19]

Stahl

[11] 4,257,347

[45] Mar. 24, 1981

[54] PROCESS AND APPARATUS FOR ELECTROPHOTOGRAPHIC DEVELOPMENT OF LATENT IMAGES ON SHEET-LIKE CARRIERS

[75] Inventor: Werner Stahl, Heimstetten, Fed. Rep. of Germany

[73] Assignee: Agfa-Gevaert Aktiengesellschaft, Leverkusen, Fed. Rep. of Germany

[21] Appl. No.: 67,823

[22] Filed: Aug. 20, 1979

[30] Foreign Application Priority Data

Aug. 23, 1978 [DE] Fed. Rep. of Germany ..... 2836837

[51] Int. Cl.[3] ..... G03G 15/10; G03G 15/22

[52] U.S. Cl. ..... 118/662; 118/638; 118/712; 118/668; 118/677; 118/689; 118/690; 324/71 R; 430/30; 430/119

[58] Field of Search ..... 118/662, 638, 712, 668, 118/669, 675, 677, 688, 689, 690; 430/30, 117, 119; 324/71 R

[56] References Cited

U.S. PATENT DOCUMENTS

| | | | |
|---|---|---|---|
| 3,094,049 | 6/1963 | Snelling | 430/30 X |
| 3,436,648 | 4/1969 | Kim | 324/71 R |
| 4,168,329 | 9/1979 | Miyakawa et al. | 430/30 |

*Primary Examiner*—John D. Welsh
*Attorney, Agent, or Firm*—Peter K. Kontler

[57] ABSTRACT

The intensity of development of latent images on dielectric receptor sheets in a liquid bath which contains a dispersion of toner particles and fills a vessel between two electrodes one of which supports a sheet in such a way that the latent image faces the other sheet is regulated by measuring the current which flows between the electrodes in response to insertion of a fresh sheet between the electrodes, comparing the measured result with a preselected reference value, and evacuating the bath from the vessel to thereby terminate the development when the ratio of measured result to the reference value is one-to-one or another preselected ratio.

5 Claims, 2 Drawing Figures

PROCESS AND APPARATUS FOR ELECTROPHOTOGRAPHIC DEVELOPMENT OF LATENT IMAGES ON SHEET-LIKE CARRIERS

BACKGROUND OF THE INVENTION

The present invention relates to an apparatus for developing latent images which are exposed onto electroradiographic sheet-like carriers. More particularly, the invention relates to an electrophotographic developing apparatus which can be resorted to for conversion of latent images into permanent images. Still more particularly, the invention relates to improvements in electrophotographic developing techniques which involve the placing of carriers of latent images into a body of dielectric liquid which is disposed between two spaced-apart electrodes and contains a dispersion of charged toner particles. The carrier of latent images in the body of dielectric liquid is adjacent to one of the electrodes.

Developing techniques of the just outlined character are often employed in the electroradiographic field because the development of latent images is highly satisfactory. This is due to the fact that the intensity of development is proportional to or improves with the extent of changes in the charge of different portions of the latent electrostatic image of an object, e.g., an object which has been examined with X-rays. Moreover, the just discussed mode of development renders it possible to completely eliminate the so-called edge effect. This is the effect according to which, in many types of developing techniques, only the marginal portions or edges of relatively large dark fields of a latent image are reproduced in full black color. The color varies from the edges toward the center, namely, from fully black to grey and even to white. Avoidance of the just discussed edge effect is especially desirable and advantageous in connection with electrophotographic reproduction of written, typed and/or printed documents.

On the other hand, the presence of some edge effect in reproductions of images which are formed by resorting to an electroradiographic technique is often advantageous because the edge effect enhances the detectability of certain details of the developed image, for example, details which are likely to be of interest to a physician.

OBJECTS AND SUMMARY OF THE INVENTION

An object of the invention is to provide a novel and improved apparatus of developing latent electrostatic images in such a way that the extent and/or influence of the edge effect can be selected and regulated within a desired range.

Another object of the invention is to provide a developing apparatus which enables the person or persons in charge to select and regulate the intensity of development, i.e., the extent of conversion of a latent electrostatic image into a visible image.

A further object of the invention is to provide an apparatus of developing latent electrostatic images in rapid sequence, with a desired degree of intensity and/or other characteristics (such as edge effect) and by resorting to a relatively simple and compact apparatus.

Another object of the invention is to provide an automatic developing apparatus which can be adjusted in advance to select the speed of development of successive latent images as well as of one or more characteristics of the developed images, e.g., the intensity of development, the pronouncedness of the edge effect and/or both.

A concomitant object of the invention is to provide the apparatus with novel and improved means for initiating the admission of a dispersion of toner particles in a dielectric fluid into or the evacuation of such dispersion from a vessel for the carriers of latent images.

One feature of the invention resides in the provision of an apparatus for preforming a process of electrophotographically developing latent images on electroradiographic sheets. The process comprises the steps of introducing a dispersion of positively and negatively charged toner particles in a dielectric hydraulic fluid between two spaced-apart electrodes which are installed in an evacuable vessel, inserting a latent image bearing sheet between the electrodes (preferably in such a way that the image-bearing side of the sheet faces one of the electrodes and the other side of the sheet abuts against the other electrode) whereby the flow of an electric current is induced between the electrodes, measuring the current, and utilizing the results of such measuring step to regulate the degree or intensity of development of latent image on the sheet intermediate the two electrodes. Thus, the current which is caused to flow as a result of insertion of a latent image bearing sheet between the electrodes in the dielectric fluid which contains a dispersion of positively and negatively charged toner particles serves as a means for selecting the extent of development, i.e., the degree to which the latent image is converted into a visible image. The current flows in the course of the electrophoresis. The measuring step may include comparing a parameter denoting the momentary value of current which flows between the electrodes with a parameter denoting a preselected reference value and the utilizing step may include terminating the development of the latent image, e.g., by actuating a relay switch which causes a pump to rapidly withdraw the fluid from the vessel, when the ratio of the two parameters reaches a preselected value.

In accordance with a presently preferred embodiment of the improved process, the measuring step includes connecting a resistor between the two electrodes and monitoring the potential difference which is caused by the resistor. Still further, the measuring step may comprise resorting to a circuit which stores the peak value of the potential difference (such peak value normally develops immediately after the insertion of a fresh sheet into the dielectric fluid) and a preferably adjustable multiplying circuit whose output transmits the reference value and which is connected with the peak value storing circuit. The momentary voltage at the resistor and the reference voltage are transmitted to the corresponding inputs of a comparing circuit whose output controls the duration of development. The aforementioned reference value is preferably a certain fraction of the stored peak value.

An important advantage of the improved process is that it renders it possible to terminate the development of a latent image at any desired time, i.e., that the extent and intensity of development can be selected in advance with a high degree of accuracy and reproducibility. Also, the extent of development can be changed from sheet to sheet with a minimum of effort and without appreciable loss in time.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
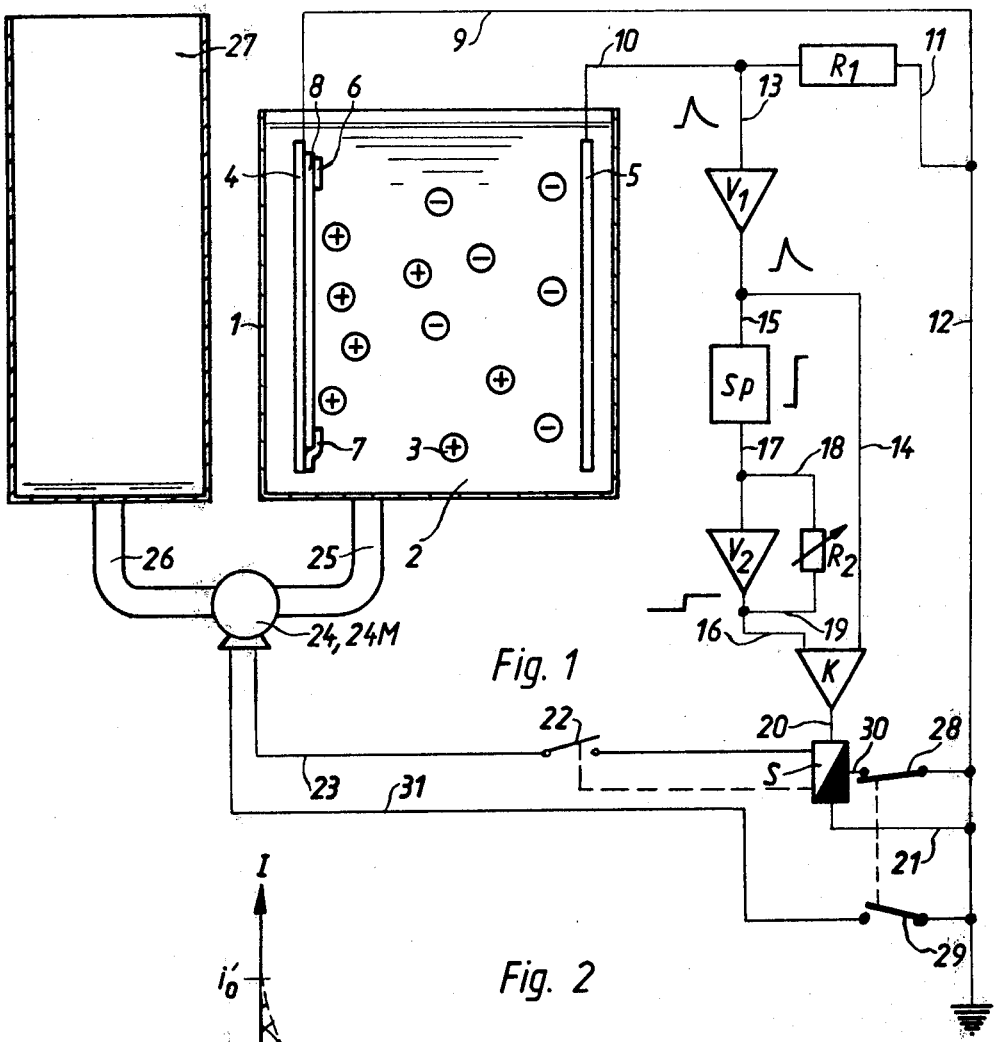
FIG. 1 is a partly diagrammatic and partly sectional view of an apparatus which embodies one form of the invention.

The developing apparatus which is shown in FIG. 1 comprises a vessel 1 for a supply of dielectric hydraulic fluid 2. The fluid 2, in turn, contains a dispersion of positively and negatively charged toner particles 3.

The vessel 1 further contains two spaced-apart electrodes 4 and 5 which dip into the supply of fluid 2. The electrode 4 is provided with at least one but preferably two or more suitable clamping elements 6 and 7 which can removably receive and hold a sheet-like carrier 8 of latent electrostatic images. For example, the sheet 8 which is shown in FIG. 1 can be inserted from above so that its lower edge rests on the clamp 7 and each of its lateral marginal portions is partially held by a discrete clamp 6. The latent image on the sheet 8 in the vessel 1 faces the electrode 5.

The electrode 4 is connected with a measuring resistor R1 by conductors 9 and 11. The other electrode 5 is connected with the resistor R1 by a conductor 10. A further conductor 12 connects the conductors 9, 11 with the ground.

The toner particles 3 which are dispersed in the dielectric fluid 2 include negatively as well as positively charged particles, particularly at the start of a developing operation. The image bearing portions of the sheet 8 are negatively charged, and such negative charges are compensated for by positive charges on the adjacent portions of the electrode 4. The just mentioned positive charges on the electrode 4 are mirror images of negative (image) charges on the sheet 8. In the course of electrophoretic development, the negative image on the sheet 8 attracts positive toner particles 3 from the fluid 2, i.e., such positively charged toner particles 3 travel toward the adjacent surface of the clamped sheet 8 whereby the positive charges of the thus attracted particles 3 are neutralized by the negative charges on the image bearing portions of the sheet 8. The mirror symmetrical positive charges of the electrode 4 are thereby free to travel toward the electrode 5 to attract the negatively charged toner particles 3 in the fluid 2 and to cause them to advance in the fluid 2 toward and onto the electrode 5. These negatively charged toner particles 3 are neutralized when they reach the electrode 5.

Figure 2:
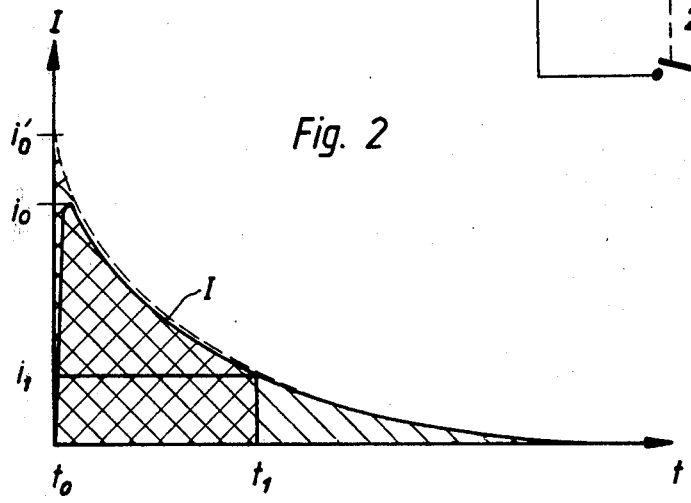
FIG. 2 is a diagrammatic view of the progress of a developing operation.

It will be noted that, in the course of electrophoretic development process, there develops a current which flows between the electrodes 4, 5 and causes a voltage drop at the measuring resistor R1. The current flows until the entire electrostatic latent image on the sheet 8 is discharged as a result of deposition of toner particles 3 thereon. As shown in FIG. 2, a relatively high current $i'_o$ develops in immediate response to insertion of a fresh electrostatically charged sheet 8 into the vessel 1, and such current rapidly decreases to a value $i_o$ during the initial interval of time subsequent to insertion of a fresh sheet 8. The decrease of current from $i_o$ to $i_1$ is more gradual during the next-following interval of time ($t_1$). The current $i_1$ which flows after elapse of the interval $t_1$ can be defined as follows:

$$i_1 = i_o \cdot e^{-t_1/\tau}.$$

The relationship with the neutralized charge on the sheet 8 can be established by ascertaining the area below the curve I of FIG. 2. The amount of charge (Q) can be ascertained by integration of the current function as follows:

$$Q = \int i_o \cdot e^{-t/\tau} \cdot dt.$$

The extent to which the latent image on the sheet 8 is developed corresponds to the ratio of the area A (between the curve I and the abscissa and ordinate of FIG. 2) and the area $A_1$ (which is bounded by the ordinate, abscissa up to the point $t_1$, and the curve I). The area A is indicated by simple hatching, and the area $A_1$ is indicated by criss-cross hatching. The areas A and $A_1$ can be calculated as follows:

$$A = \int_0^{\infty} i \cdot dt,$$

$$A_1 = \int_0^{t_1} i \cdot dt.$$

The ratio of the areas $A_1$ and A (i.e., the intensity or extent of development of the sheet 8) can be ascertained as follows:

$$A_1/A = \int_0^{t_1} i \cdot dt / \int_0^{\infty} i \cdot dt.$$

As regards the ascertainable ratio of the momentary value $i_1$ of the current flowing between the electrodes 4, 5 and the initial value $i_o$ of such current, there exists the following relationship:

$$i_1/i_o = 1 - A_1/A = 1 - \text{extent or degree of development.}$$

The curve I of FIG. 2 further shows that the actually achieved peak voltage at the start of the development closely approximates that which corresponds to the theoretically possible peak current value $i'_o$ if one insures that, at the start of the developing operation, the developing fluid is supplied to the exposed surface of the sheet 8 as rapidly as possible and in the form of a laminar stream. For example, this can be achieved by resorting to a dipping device for the sheet 8 or by resorting to a fluid recirculating arrangement, e.g., an arrangement of the type shown in FIG. 1. The preceding equations are valid provided that, based on a uniform rinsing speed at the start of the developing operation, the ratio $i'_o/i_o$ remains at least substantially constant.

FIG. 1 shows that, in order to ascertain the momentary value of the current which flows between the electrodes 4, 5 in the course of the electrophoretic developing operation, as well as to interrupt the developing operation when the desired degree or extent of development is reached, one can resort to the following circuit:

The conductor 10 which connects the electrode 5 with the measuring resistor R1 is further connected with the input of an amplifier $V_1$ by means of a further conductor 13. The purpose of the amplifier $V_1$ is to change the voltage (corresponding to current which is represented by the curve I of FIG. 2) to a voltage having a different (higher) amplitude. The two voltages are schematically shown to the left and above and to the right and below the amplifier $V_1$. The amplitude-modified voltage is transmitted to one input of a comparator circuit K via conductor 14, and to a peak value storing circuit Sp via conductor 15. The circuit Sp stores the maximum voltage value (i.e., the initially transmitted voltage impulse), and its input transmits a constant voltage signal (schematically shown to the right of the circuit Sp) having an amplitude which corresponds to the peak value.

The voltage signal at the output of the circuit Sp is transmitted to an adjustable multiplying circuit $V_2$, $R_2$ and the intensity of such signal is reduced (as shown to the left of the component $V_2$) to an extent corresponding to the desired degree of development of the sheet 8. The voltage signal (reference signal) of reduced intensity is transmitted to the left-hand input of the comparator circuit K via conductor 16. The conductors 17, 18 connect the output of the circuit Sp with the components $V_2$, $R_2$ of the multiplying circuit, and the conductor 19 connects the outputs of the components $V_2$, $R_2$.

The circuit K compares the momentary value (transmitted via conductor means 14) of the voltage at the resistor $R_1$ with the somewhat reduced peak value (i.e., with the reference value) which is transmitted via conductor 16. Since the voltage at the resistor $R_1$ is proportional to the current which flows between the electrodes 4 and 5, a relay S is energized at the exact moment when a certain preselected current $i_1$ flows between the electrodes 4 and 5. The relay S is respectively connected to the ground (via conductor 12) and to the comparator circuit K by conductors 21 and 20. The energized relay S actuates a switch 22 at the time $t_1$ so that the conductor 23 for the switch 22 can transmit a signal which starts the reversible motor 24M of a pump 24 in a first direction. The pump 24 then rapidly causes the fluid 2 to flow from the vessel 1 into a reservoir 27 and to thus complete the developing operation. The motor 24M is preferably a tandem motor, and it causes the pump 24 to convey the fluid 2 in the opposite direction (from the reservoir 27 into the vessel 1) when the switch 22 opens and the relay S closes a switch 29 in a conductor 31 connecting the relay S with the motor 24M. The reference characters 25, 26 respectively denote the conduits which connect the pump 24 with the vessel 1 and reservoir 27. The velocity with which the pump 24 can transfer the fluid 2 from the vessel 1 into the reservoir 27 is preferably sufficiently high so that the development of latent image on a sheet 8 which is clamped to the electrode 4 is terminated almost instantaneously, i.e., after elapse of the interval $t_1$ following the start ($t_o$) of the developing operation.

The interval $t_1$ determines the aforediscussed ratio $A_1/A$ and hence the degree of development of the image on the sheet 8 in the vessel 1.

In order to start the development of image on the next sheet 8, the relay S actuates a switch 28 which is mechanically or otherwise coupled to the aforementioned switch 29. The latter causes the conductor 31 to transmit a signal which starts the motor 24M in reverse, i.e., the fluid 2 is pumped from the reservoir 27 into the vessel 1. The switch 28 is connected with the relay S by a conductor 30 which forms part of the holding circuit of the relay. Such holding circuit is broken when the motor 24M is operated in reverse. The inflow of fluid into the vessel 1 is preferably rapid so that the development of image on the freshly introduced sheet 8 can begin practically instantaneously.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claim.

I claim:

1. Apparatus for electrophotographic development of latent images on electroradiographic sheets, comprising a vessel for a dispersion of charged toner particles in a dielectric fluid; a pair of spaced-apart electrodes disposed in said vessel and dipping into said fluid, a sheet whose latent image is to be developed being adjacent to one of said electrodes in said fluid whereby the inserted sheet induces the flow of an electric current between said electrodes; measuring means including resistor means connected between said electrodes to establish a potential difference while said current flows between said electrodes, a source of reference voltage, and a comparator circuit having a first input connected to said resistor means, a second input connected to said source of reference voltage, and an output which transmits output signals denoting the difference between said reference voltage applied to said second input and the voltage taken off said resistor means and applied to said first input; and means for regulating the development of the latent image in said vessel as a function of said output signals.

2. The apparatus of claim 1, wherein said regulating means includes means for interrupting the development of latent image in said vessel.

3. The apparatus of claim 2, wherein said interrupting means includes electric switch means.

4. The apparatus of claim 1, wherein said source of reference voltage comprises a circuit for storage of peak voltage signals and a multiplying circuit connected in series with said storage circuit and further connected to said second input.

5. The apparatus of claim 4, wherein said multiplying circuit includes means for changing said reference voltage.

* * * * *